US008960964B2

(12) United States Patent
Weaver

(10) Patent No.: US 8,960,964 B2
(45) Date of Patent: Feb. 24, 2015

(54) THERMAL DISSIPATION STRUCTURE FOR LIGHT EMITTING DIODE

(75) Inventor: Matthew D. Weaver, Aptos, CA (US)

(73) Assignee: Lumenetix, Inc., Scotts Valley, CA (US)

( * ) Notice: Subject to any disclaimer, the term of this patent is extended or adjusted under 35 U.S.C. 154(b) by 99 days.

(21) Appl. No.: 13/367,187

(22) Filed: Feb. 6, 2012

(65) Prior Publication Data

US 2013/0201676 A1 Aug. 8, 2013

(51) Int. Cl.

| | |
|---|---|
| ***F21V 29/00*** | (2006.01) |
| ***F21V 9/00*** | (2006.01) |
| ***F21S 4/00*** | (2006.01) |
| ***F21V 21/00*** | (2006.01) |
| ***F21V 9/16*** | (2006.01) |

(52) U.S. Cl.
USPC ..... 362/294; 362/231; 362/230; 362/249.02; 362/84

(58) Field of Classification Search
USPC ..... 362/231, 230, 235–238, 240, 244–246, 362/249.01, 249.02, 294
See application file for complete search history.

(56) References Cited

U.S. PATENT DOCUMENTS

| | | | | |
|---|---|---|---|---|
| 5,099,348 | A | 3/1992 | Huddleston et al. | |
| 5,457,478 | A | 10/1995 | Frank | |
| 6,128,117 | A | 10/2000 | Kim | |
| 6,411,046 | B1 | 6/2002 | Muthu | |
| 6,799,864 | B2 * | 10/2004 | Bohler et al. | 362/236 |
| 7,423,387 | B2 | 9/2008 | Robinson | |
| 7,575,339 | B2 * | 8/2009 | Hung | 362/230 |
| 8,485,687 | B2 * | 7/2013 | McQuistian et al. | 362/247 |
| 2002/0097000 | A1 | 7/2002 | Muthu et al. | |
| 2002/0114155 | A1 | 8/2002 | Katogi et al. | |
| 2004/0008992 | A1 | 1/2004 | Nishimura | |
| 2004/0105264 | A1 | 6/2004 | Spero | |
| 2005/0030744 | A1 | 2/2005 | Ducharme et al. | |
| 2005/0047134 | A1 | 3/2005 | Mueller et al. | |
| 2005/0128751 | A1 | 6/2005 | Roberge et al. | |
| 2005/0265029 | A1 * | 12/2005 | Epstein et al. | 362/339 |
| 2007/0183163 | A1 | 8/2007 | Daniel | |
| 2007/0248047 | A1 | 10/2007 | Shorty et al. | |

(Continued)

FOREIGN PATENT DOCUMENTS

| | | | |
|---|---|---|---|
| JP | 2006-011628 | A | 1/2005 |
| JP | 2006-059605 | A | 3/2006 |

(Continued)

OTHER PUBLICATIONS

Co-Pending U.S. Appl. No. 12/396,399 of Weaver, M.D., filed Mar. 2, 2009.

(Continued)

*Primary Examiner* — Peggy Neils
*Assistant Examiner* — William N Harris
(74) *Attorney, Agent, or Firm* — Perkins Coie LLP

(57) ABSTRACT

The tunable color mixing system includes a mixing barrel that captures light from multiple light emitting diodes emitting at different colors, mixes the light, and outputs the light with a narrow beam angle from a small area. The array of LEDs in the system is thermally coupled to a heat conductor via thermal pads. A flexible printed circuit is electrically connected to the LEDs to supply and fine-tune the electrical power. The array includes LEDs of at least three emitting colors to achieve an output light having a high color rendering index, tunable to a wide range of correlated color temperatures.

31 Claims, 11 Drawing Sheets

(56) References Cited

U.S. PATENT DOCUMENTS

| | | | | |
|---|---|---|---|---|
| 2008/0062682 | A1* | 3/2008 | Hoelen et al. | 362/231 |
| 2008/0191631 | A1 | 8/2008 | Archenhold et al. | |
| 2009/0040750 | A1 | 2/2009 | Myer | |
| 2009/0152576 | A1* | 6/2009 | Naum et al. | 257/94 |
| 2009/0184648 | A1 | 7/2009 | Colak et al. | |
| 2009/0218951 | A1 | 9/2009 | Weaver | |
| 2009/0267524 | A1 | 10/2009 | Draaijer et al. | |
| 2010/0110672 | A1 | 5/2010 | Durand et al. | |
| 2010/0188004 | A1 | 7/2010 | Baggen et al. | |
| 2010/0231363 | A1 | 9/2010 | Knibbe | |
| 2010/0244746 | A1 | 9/2010 | Van De Sluis et al. | |
| 2010/0301776 | A1 | 12/2010 | Feri et al. | |
| 2011/0037409 | A1* | 2/2011 | Van De Ven et al. | 315/294 |
| 2011/0044701 | A1 | 2/2011 | Schenk et al. | |

FOREIGN PATENT DOCUMENTS

| | | | |
|---|---|---|---|
| WO | WO-02/13490 | A2 | 2/2002 |
| WO | WO-02/47438 | A2 | 6/2002 |
| WO | WO-02/082283 | A2 | 10/2002 |
| WO | WO-02/082863 | A1 | 10/2002 |
| WO | WO-03/055273 | A2 | 7/2003 |
| WO | WO-2004/057927 | A1 | 7/2004 |
| WO | WO-2006/111934 | A1 | 10/2006 |
| WO | WO-2007/125477 | A2 | 11/2007 |

OTHER PUBLICATIONS

Co-Pending U.S. Appl. No. 12/782,038 of Weaver, M. et al., filed May 18, 2010.

Co-Pending U.S. Appl. No. 13/627,926 of Weaver, M.D., filed Sep. 26, 2012.

Co-Pending U.S. Appl. No. 13/655,679 of Weaver, M.D., filed Oct. 19, 2012.

Co-Pending U.S. Appl. No. 13/655,738 of Weaver, M.D., filed Oct. 19, 2012.

Co-Pending U.S. Appl. No. 13/766,695 of Bowers, D. et al., filed Feb. 13, 2013.

Co-Pending U.S. Appl. No. 13/766,707 of Bowers, D., filed Feb. 13, 2013.

Co-Pending U.S. Appl. No. 13/766,745 of Bowers. D. et al., filed Feb. 13, 2013.

Co-Pending U.S. Appl. No. 13/770,595 of Weaver, M.D., filed Feb. 19, 2013.

Co-Pending U.S. Appl. No. 13/848,628 of Weaver, M.D., filed Mar. 21, 2013.

Non-Final Office Action Mailed Sep. 23, 2011 in Co-Pending U.S. Appl. No. 12/396,399 of Weaver, M.D., filed Mar. 2, 2009.

Final Office Action Mailed Dec. 5, 2012 in Co-Pending U.S. Appl. No. 12/396,399 of Weaver, M.D., filed Mar. 2, 2009.

Non-Final Office Action Mailed Jan. 4, 2013 in Co-Pending U.S. Appl. No. 12/396,399 of Weaver, M.D., filed Mar. 2, 2009.

Notice of Allowance Mailed Mar. 20, 2013 in Co-Pending U.S. Appl. No. 12/396,399 of Weaver, M.D., filed Mar. 2, 2009.

Restriction Requirement mailed Mar. 25, 2013 for Co-Pending U.S. Appl. No. 12/782,038 of Weaver. M., filed May 18, 2010.

Non-Final Office Action Mailed Dec. 4, 2012 in Co-Pending U.S. Appl. No. 13/627,926 Weaver, M.D., filed Sep. 26, 2012.

Non-Final Office Action Mailed Feb. 28, 2013 in Co-Pending U.S. Appl. No. 13/655,738 Weaver, M.D., filed Oct. 19, 2010.

International Search Report mailed Dec. 28, 2010. for International Patent Application No. PCT/2010/035295 filed May 18, 2010, pp. 1-8.

Written Opinion mailed Dec. 28, 2010, for International Patent Application No. PCT/2010/035295 filed May 18, 2010, pp. 1-5.

Non-Final Office Action mailed Dec. 5, 2013, for Co-Pending U.S. Appl. No. 12/782,038 by Weaver, M., filed May 18, 2010.

Notice of Allowance Mailed May 13, 2014, for Co-Pending U.S. Appl. No. 12/782,038 by Weaver, M., filed May 18, 2010.

* cited by examiner

THERMAL DISSIPATION STRUCTURE FOR LIGHT EMITTING DIODE

CROSS-REFERENCES TO RELATED APPLICATIONS

This application is related to U.S. application Ser. No. 12/782,038, entitled, "LAMP COLOR MATCHING AND CONTROL SYSTEMS AND METHODS", filed May 18, 2010 and U.S. Provisional Application No. 61/289,914, entitled, "OPTICAL ADDRESSING AND COLOR MATCHING," filed Nov. 10, 2009, both of which are incorporated herein in their entirety.

BACKGROUND

Light emitting diodes (LEDs) that emit at different wavelength bands can be used together to provide light that has a desired color temperature, for example, simulating a particular light source.

LEDs typically have a preferred operating temperature. Thus, it is important to dissipate the heat generated by the LEDs in a LED-based lighting system that has multiple LEDs.

BRIEF DESCRIPTION OF THE DRAWINGS

Examples of an LED-based lighting system are illustrated in the figures. The examples and figures are illustrative rather than limiting.

DETAILED DESCRIPTION

A mixing barrel apparatus is described for mixing light from an array of LEDs that emit light having different colors.

Although the array can be quite large, the mixing barrel funnels the light from the array and re-emits the light from a smaller area, thus resulting in a narrow beam pattern being emitted from the lamp that houses the LED array. Additionally, as the light reflects multiple times from the inner surface of the mixing barrel, the light from the different color LEDs are mixed. In one embodiment, the mixing barrel has an air cavity. In another embodiment, the mixing barrel contains a transparent refractive block that causes at least a portion of the light emitted by the LED array to be totally internally reflected within the refractive block to minimize loss of light occurring upon reflection from the mixing barrel surface.

Various aspects and examples of the invention will now be described. The following description provides specific details for a thorough understanding and enabling description of these examples. One skilled in the art will understand, however, that the invention may be practiced without many of these details. Additionally, some well-known structures or functions may not be shown or described in detail, so as to avoid unnecessarily obscuring the relevant description.

The terminology used in the description presented below is intended to be interpreted in its broadest reasonable manner, even though it is being used in conjunction with a detailed description of certain specific examples of the technology. Certain terms may even be emphasized below; however, any terminology intended to be interpreted in any restricted manner will be overtly and specifically defined as such in this Detailed Description section.

A light emitting diode (LED) emits light in a narrow band of wavelengths. Two or more LEDs emitting in different wavelength bands can be used together in a lamp to generate composite light having a desired color temperature. When light from multiple LEDs are used together, the light from the LEDs should be mixed so that the light appears uniform, rather than as localized spots of different color light. Additionally, when multiple LEDs are used in an LED array, the array has a large area and does not provide a narrow output beam angle. Described below is a mixing barrel that can be used to homogenize the light emitted from an LED array and to effectively provide a small source with a narrow output beam angle.

Mixing Barrel with Air Cavity

Figure 1:
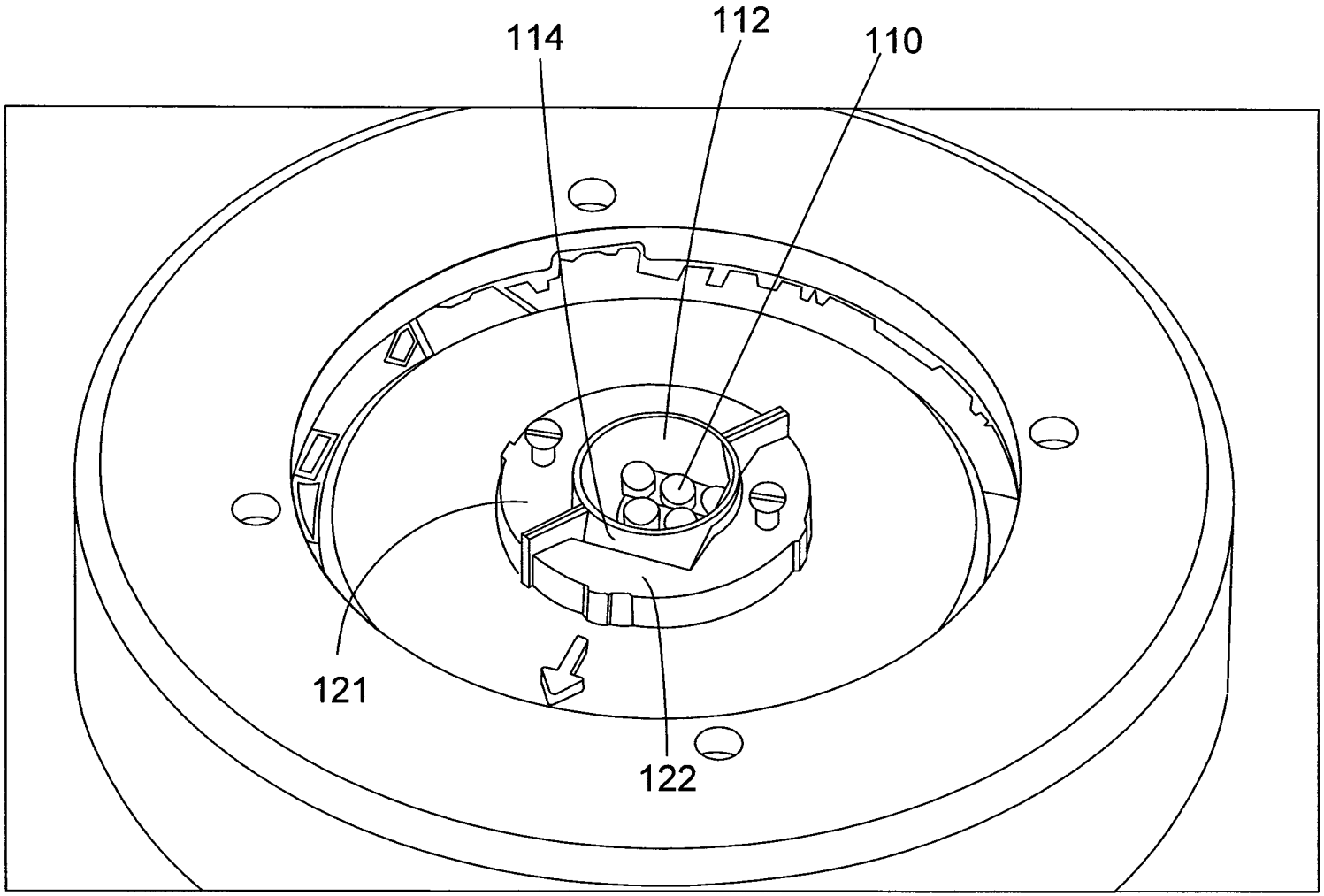
FIG. 1 shows a perspective view illustrating an example mixing barrel in an LED-based lamp.

FIG. 1 shows a perspective view illustrating an example mixing barrel in an LED-based lamp. The LED-based lamp includes an LED array 110 that has multiple LEDs, and the LEDs emit light at two or more different wavelength bands.

In one embodiment, the mixing barrel has two sections 112, 114 that are clamped together by holders 121, 122. In one embodiment, the holders 121, 122 suspend the mixing barrel sections 112, 114 slightly above the LED array 110 so that there is a clearance space between the mixing barrel and the LED array 110 to prevent pressure from being placed on the array.

In one embodiment, each of the sections 112, 114 of the mixing barrel is made from formable sheet metal, such as aluminum. The lower edge of the sheet metal sections that is closest to the LED array is crimped to form a shape that conforms, or nearly conforms, to the shape of the LEDs in the array, while the upper edge of the sheet metal sections farthest from the array is smooth. Note that while the terms 'lower edge' and 'upper edge' are used to describe the mixing barrel, the mixing barrel can be oriented in any direction. Because the lower edge of the barrel is crimped to follow the small features that correspond to the shape of the LEDs, the metal of the mixing barrel should be fairly thin. By shaping the lower edge of the mixing barrel to match the shape of the LEDs, the amount of light emitted by the LEDs that is captured by the mixing barrel can be maximized. Additionally, the total length of the crimped lower edge and the smooth upper edge are substantially equal for ease of manufacturing the mixing barrel.

Once captured, the light from the LEDs reflects multiple times against the inner surface of the mixing barrel as it is funneled towards the upper edge of the mixing barrel. In one embodiment, the inner surface of the mixing barrel is coated with a highly reflective specular coating, such as a silver coating. By using a highly reflective specular coating, the energy lost each time light from the LEDs reflects from the surface of the mixing barrel is minimized. Further, a transparent coating, such as silicon dioxide, can be placed over the specular coating as a protective layer.

In one embodiment, instead of coating the inner surface of the mixing barrel with a highly reflective coating, a highly reflective diffusive substrate can be used, such as White 97 film or DuPont™ DLR80 from WhiteOptics of Newark, Del. or a Teflon™-based solid, such as Gore DRP from W. L. Gore & Associates, Inc. of Newark, Del. By using a highly reflective diffuse material, light impinging on the surface is reflected at multiple angles, resulting in further mixing of the different colors of light from the LEDs.

In another embodiment, the mixing barrel can be formed using a plastic injection-molded mixing barrel that is electroless nickel plated to form a metallic base coat. The base coat is then coated with a highly reflective specular coating, such as silver or aluminum, and optionally coated with a high reflectivity dielectric stack coating.

In yet another embodiment, the mixing barrel can be made from press-molded glass that is coated with a highly reflective specular coating.

With either the press-molded glass or plastic injection-molded mixing barrel, the diffusive reflective materials specified above can be conformally applied to the surface of mixing barrel. Alternatively, there are diffuse white reflector coatings that can be applied to the mixing barrel surface that have nearly the same performance but are more delicate. For example, barium sulfate ($BaSO_4$) can be applied as a powder-spray to the surface by using a carrier solution such as polyvinyl alcohol (PVA). High reflectivity white diffuse paints can also be used that typically contain a high percentage of $BaSO_4$.

Figure 2A:
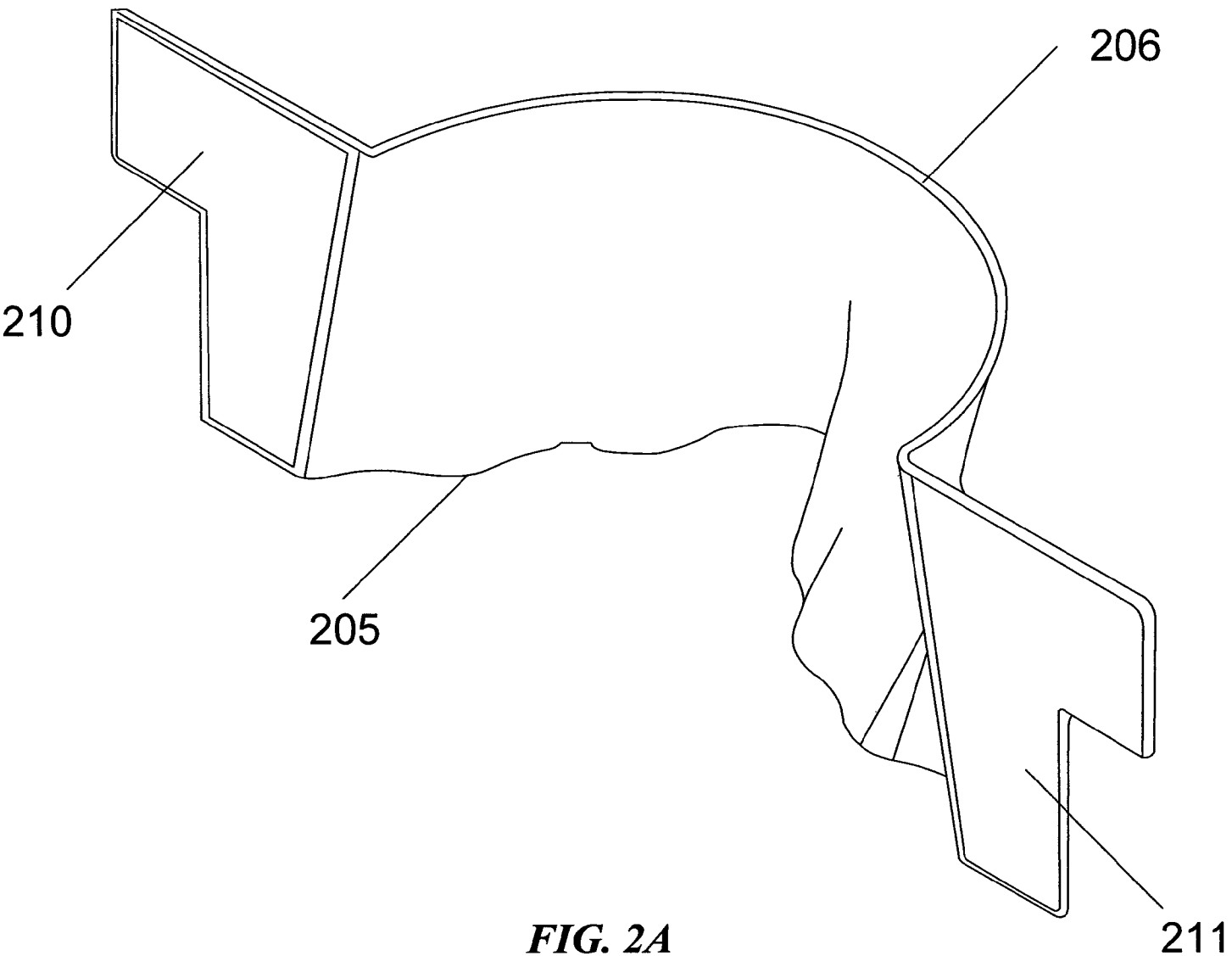
FIG. 2A shows a perspective view of an example section of the mixing barrel.
Figure 2B:
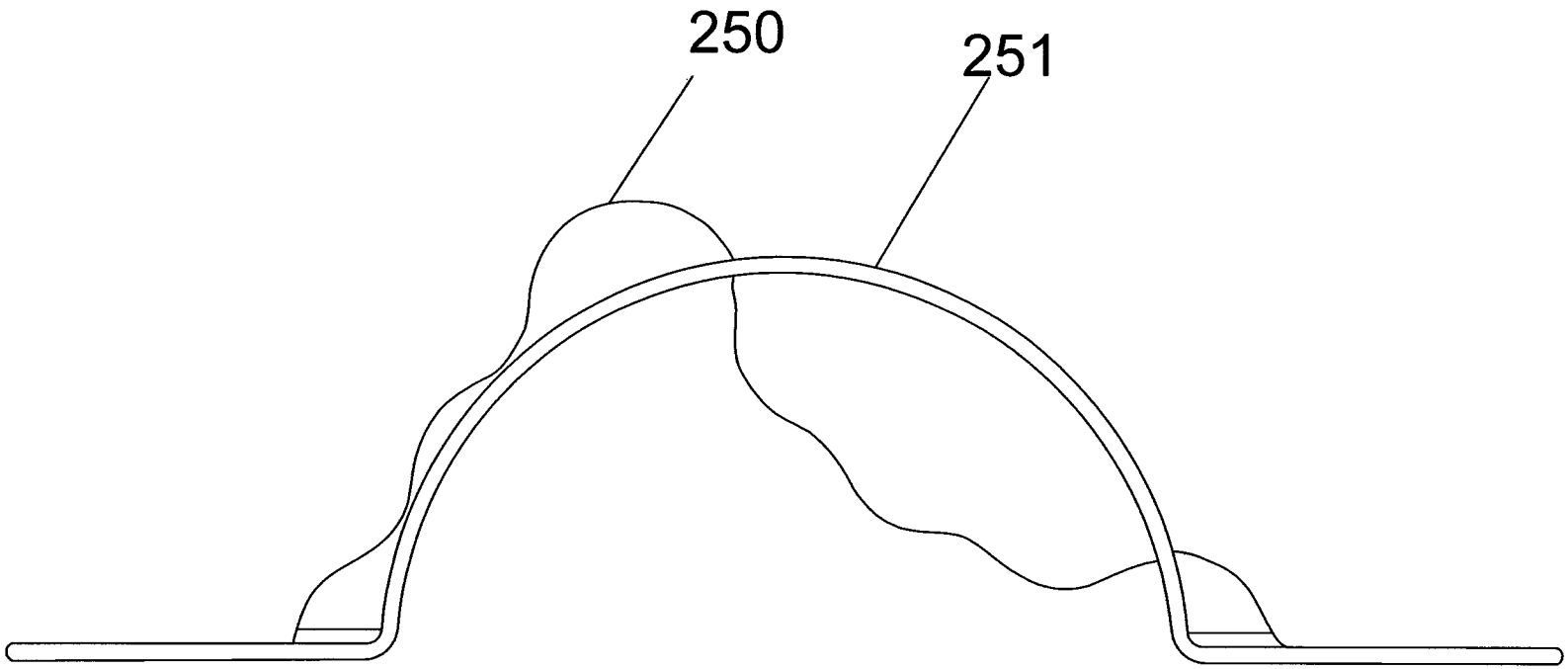
FIG. 2B shows a superposition of the shape of the lower edge and the upper edge of an example mixing barrel section

FIG. 2A shows a perspective view of an example section of the mixing barrel. The crimped lower edge 205 is gradually smoothed into, in this example, a half circle at the upper edge 206. FIG. 2B shows a superposition of the shape of the lower edge 250 and the shape of the upper edge 251 of an example mixing barrel section.

Additionally, in this example, the mixing barrel section has two flat portions 210, 211 at the ends. These flat portions 210, 211 are clamped to the corresponding flat portions on the opposing mixing barrel section to form the reflective cavity of the mixing barrel.

Figure 3:
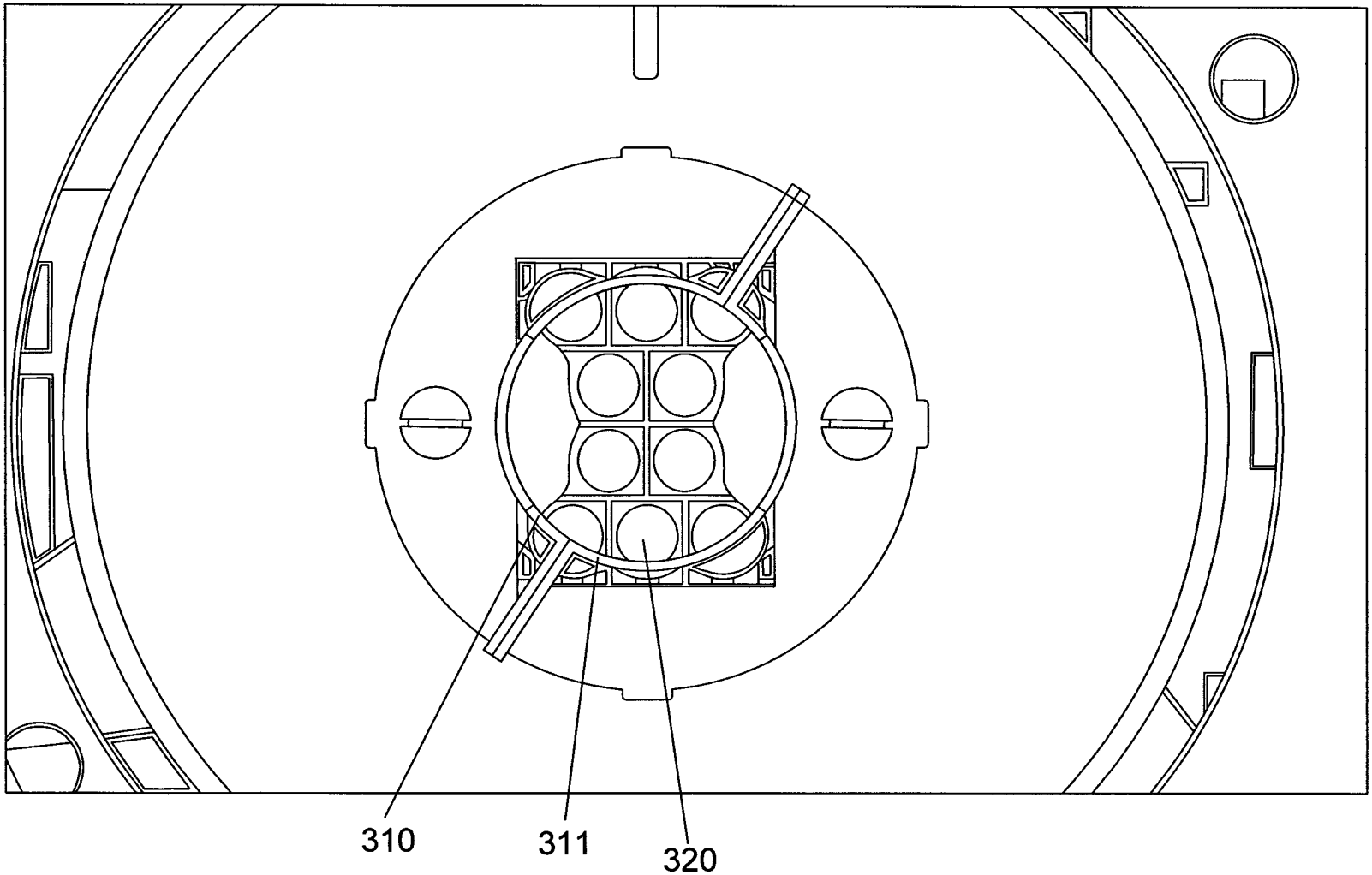
FIG. 3 shows a top view of example mixing barrel sections clamped together.

FIG. 3 shows a top view of example mixing barrel sections 310, 311 clamped together. The holder clamping the mixing barrel sections together is shown to be transparent in this figure to show the relative positioning of the LED array 320 and the mixing barrel sections 310, 311.

Figure 4:
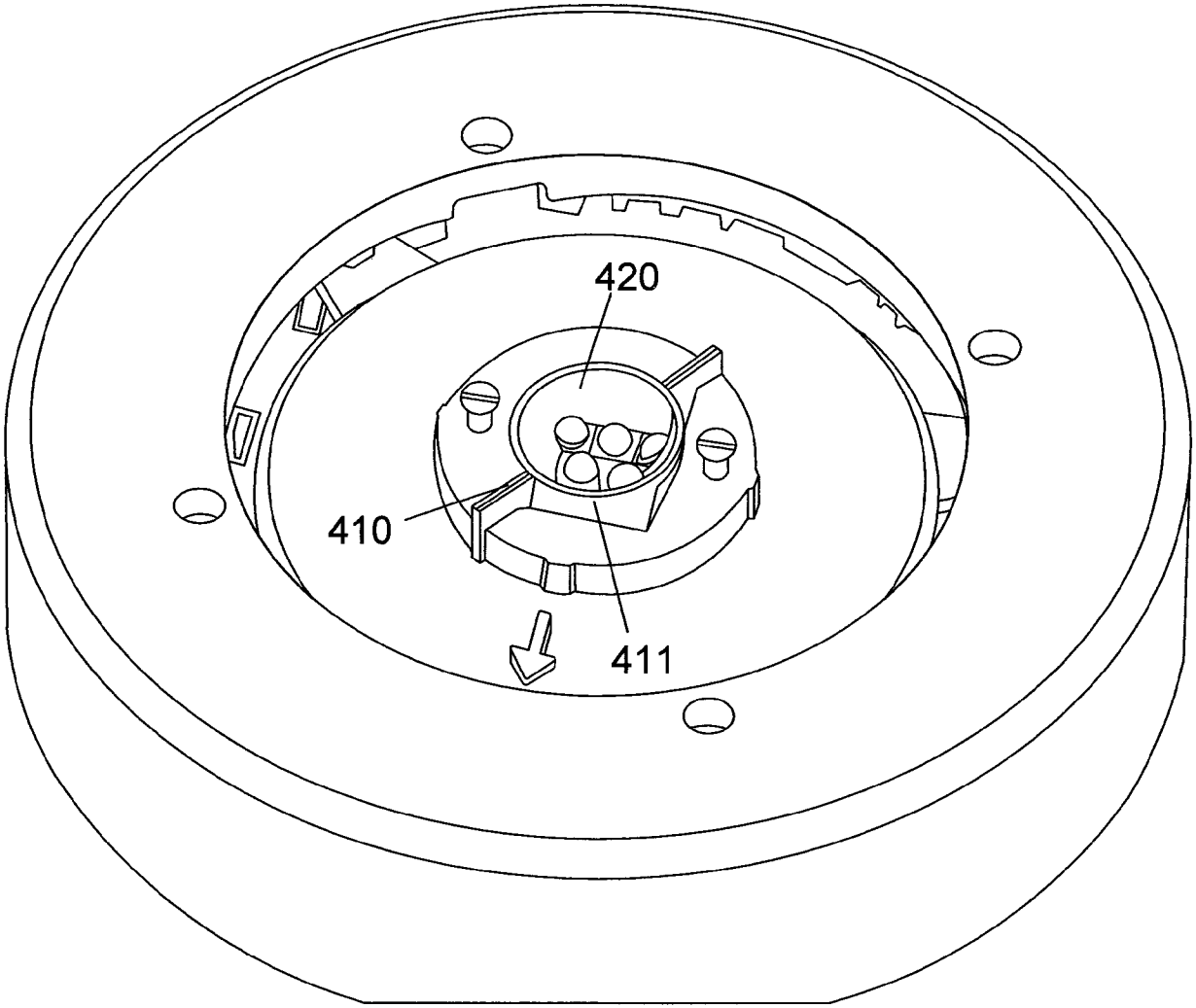
FIG. 4 shows a perspective view illustrating an example mixing barrel covered by a diffuser plate.

FIG. 4 shows a perspective view of example mixing barrel sections 410, 411 with a diffuser 420 seated on the upper edge of the sections 410, 411. The diffuser serves to further mix the light from the different color LEDs exiting beyond the upper edge of the mixing barrel to smooth out any hot spots from the individual LEDs in the LED array. The diffuser can be made from plastic or glass.

Figure 5:
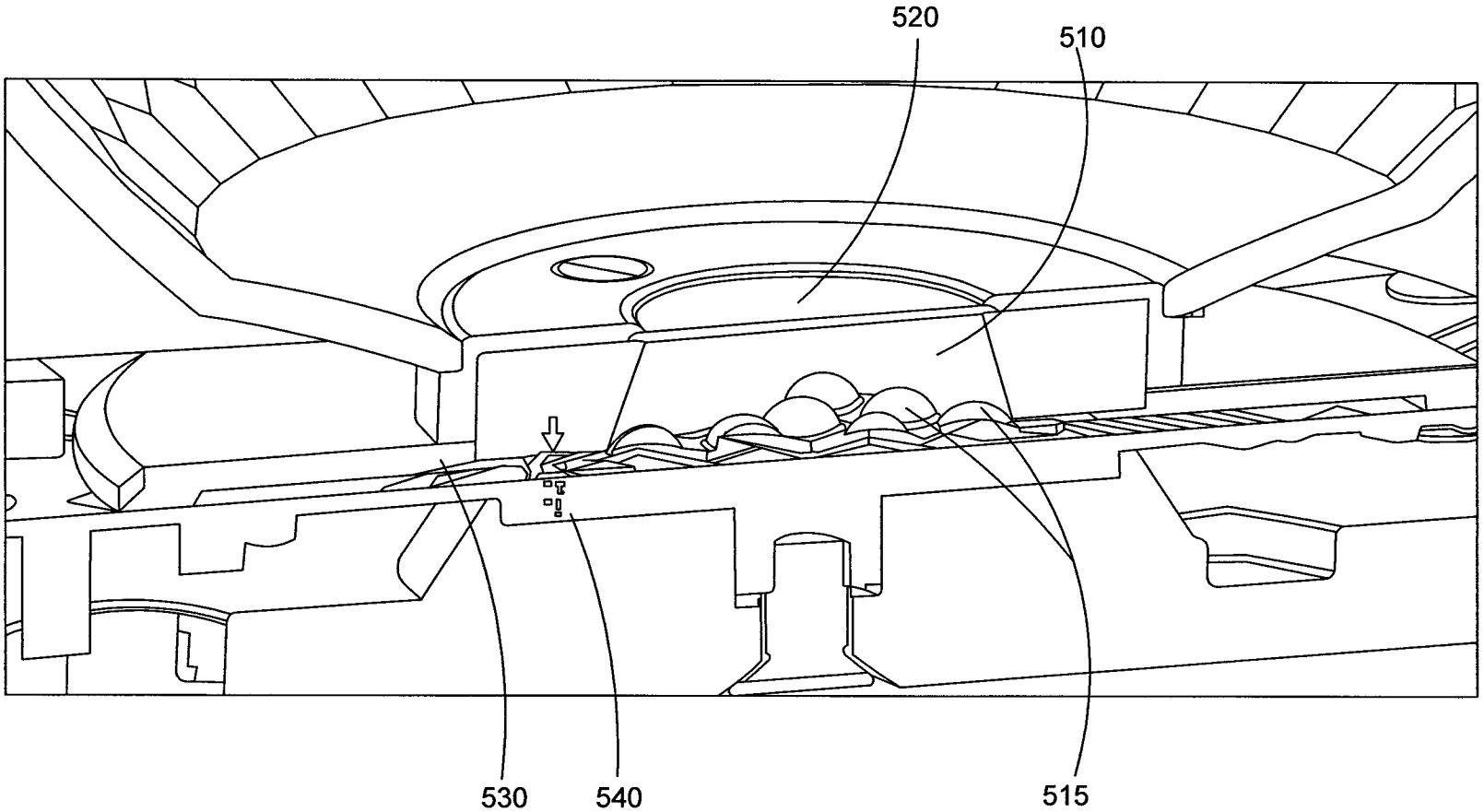
FIG. 5 shows a cross-section of an example LED-based lighting system that includes a mixing barrel.

FIG. 5 shows a cross-section of an example LED-based lighting system that includes the mixing barrel 510. In one embodiment, the mixing barrel 510 is seated on a supporting plate 530 so that the mixing barrel does not contact the LED array 515. The small gap 540 between the LED array and the mixing barrel 510 is in a low loss region where the amount of direct light flux from the LEDs is very low and the scatter flux density of light from within the mixing barrel is also low. Further, FIG. 5 shows the diffuser plate 520 seated on the top edge of the mixing barrel 510.

Mixing Barrel with Refractive Block

Despite the use of highly reflective coatings on the inner surface of the mixing barrel, each time light reflects from the inner surface of the mixing barrel, some energy is lost since even the best reflective coatings are lossy. One way to minimize the number of reflections against the wall of the mixing barrel while still sufficiently mixing the light from the LEDs is to use a total internal reflection (TIR) mechanism within the mixing barrel. In one embodiment, a block of refractive material is used to replace a portion of the air cavity within the mixing barrel. Because the light from the LED array that impinges on the mixing barrel can have a large range of incidence angles, it is difficult to design a shape for the refractive material that causes all the light from the LED array to be totally internally reflected. However, the shape of the refractive block is designed with the result that at least some of the light from the LEDs undergoes total internal reflection within the refractive block.

While the refractive block is placed within the mixing barrel, there should be a narrow air gap between the refractive block and the inner wall of the mixing barrel to ensure that the TIR mechanism works. Any contact between the refractive block and the mixing barrel wall causes light to leak out to the mixing barrel wall and reflect off of the wall with the accompanying energy loss.

Similarly, if there is contact between the refractive block and the mixing barrel, light reflected onto the points of contact can leak out. However, in some embodiments, it may be advantageous to optically couple the refractive block to the LED array by placing an optical silicone gel between the refractive block and the optical silicone gel dome that is already present on high-volume single LED packages. Then the additional optical silicone gel acts as an index matching material to minimize the loss of light entering the mixing barrel.

In one embodiment, a diffuser plate is bonded to the top of the refractive block, and the diffuser plate is seated on top of the mixing barrel's upper edge. This arrangement suspends the refractive block above the LED array below the mixing barrel, thus preventing the refractive block from making contact with the LED array.

The diffuser plate can also serve as a registration mechanism to center the refractive block within the mixing barrel so that there is an air gap between the mixing barrel reflective wall and the refractive block on all sides.

Another advantage to using the refractive block is that it acts as a heatsink for the diffuser plate. In the configuration for the mixing barrel that has an unfilled air cavity, the diffuser plate itself is very thin and thus, has a very small heat capacity. Further, it is surrounded above and below by air that acts as an insulator. If the surface of the diffuser has an impurity, for example, flecks of dust, the impurity will absorb the energy of the light and produce carbonization on the diffuser material causing further energy absorption and eventually burning up the diffuser. However, if the diffuser material is laminated to the refractive block, the block acts as a heat sink for any heat energy absorbed by the diffuser, thus mitigating heat build up at the diffuser.

Figure 6:
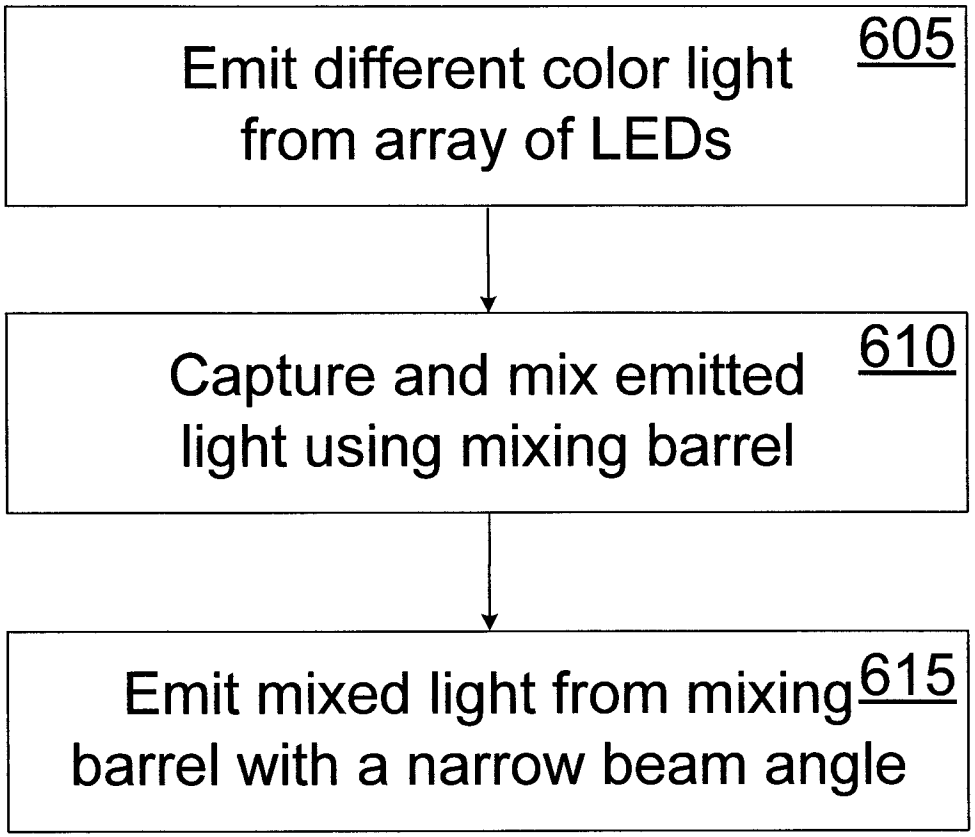
FIG. 6 is a flow diagram illustrating an example process of mixing light from an LED array using a mixing barrel.

FIG. 6 is a flow diagram illustrating an example process of mixing light from an LED array using a mixing barrel. At block 605, the system emits light from an array of LEDs, and the LEDs emit light at different wavelength bands.

Then at block 610, the light emitted from the LED array is captured by the mixing barrel. If the mixing barrel has an air cavity, the captured light is mixed as a result of multiple reflections of the light from the inner reflective surface of the mixing barrel. If the mixing barrel has a refractive block, that light is either totally internally reflected within the block or exits the block to be reflected by the inner reflective surface of the mixing barrel and re-enters the refractive block. The light continues to be either totally internally reflected or reflected by the mixing barrel surface until at block 615, the funnel shape of the mixing barrel causes the light to be emitted from the top of the mixing barrel with a narrow beam angle. In one embodiment, the top of the mixing barrel is covered with a diffuser to further diffuse the light emitted from the mixing barrel.

The light emitted from the mixing barrel, with or without the diffuser, is nearly Lambertian. However, because the exit window of the mixing barrel is relatively small, it acts as a smaller source having a lower etendue than the LED array would have alone. As a result, secondary optics used in conjunction with the mixing barrel can generate narrower beam angles than the LED array alone.

High Density LED Array

Figure 7:
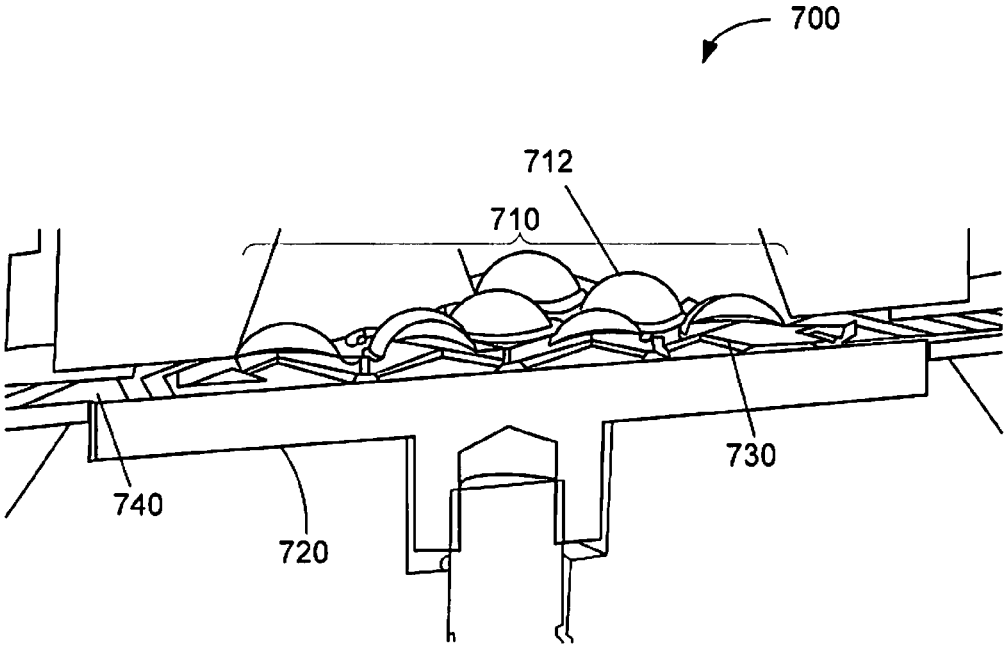
FIG. 7 shows a perspective view illustrating a sample apparatus including a high density LED array.

A lighting apparatus having a high density LED array using high volume, low cost, reliable LEDs is described. The apparatus may utilize the mixing barrel discussed in previous sections of the disclosure. FIG. 7 illustrates a sample apparatus including a high density LED array. The apparatus 700 includes a planar array 710 of LEDs 712. In one embodiment, the LEDs 712 are high-power LED packages such as Lumiled Luxeon Rebel or CREE XRG. These LED packages are highly-tested, high-volume, proven LED packages. The LEDs 712 are mechanically mounted on top of a heat conductor 720. For each of LEDs 712, there is a thermal pad 730 between the LED and the heat conductor 720. The thermal pad may contain copper. In one embodiment, there is an individual thermal pad beneath each LED. In another embodiment, one or more LEDs may share one thermal pad. The LED is thermally coupled to the thermal pad 730 and then the thermal pad 730 is thermally coupled to the heat conductor 720. In one embodiment, the LED is thermally coupled by means of solder or oriented carbon fiber film. The heat conductor may be a coin-shaped article made of copper. Thus, most heat generated by the LEDs 712 is transferred to the heat conductor 720 with very little heat resistance. The heat conductor may connect to another heat sink to further dissipate the heat. A flexible printed circuit 740 is designed to electrically connect to all the LEDs 712 of the array 710 via their electrical contacts. A flexible printed circuit is a patterned arrangement of printed wiring utilizing flexible base material with or without flexible cover layers. The flexible printed circuit uses flexible base material so that mechanical stress due to the thermal expansion and contraction is minimized and cracking is prevented. The apparatus has superior thermal dissipation ability because the heat generated by the LEDs 712 flows through a thermal channel of the thermal pad 730 and the heat conductor 720 with minimum thermal resistance. Therefore, it is possible to arrange the LEDs 712 in close proximity while not overheating the LEDs. The LEDs 712 may be arranged with an average spacing between the neighboring LEDs of less than 4 millimeters, preferably less than 3 millimeters. As shown in FIG. 7, the LED array 710 forms a planar Lambertian disc with a diameter of from about 10 millimeters to about 18 millimeters. The light intensity from the planar Lambertian disc to an observer is the same regardless of the observer's angle of view. The design is a lighting solution with low cost, high efficacy and reliability. The product life may exceed 50,000 hours.

Figure 8:
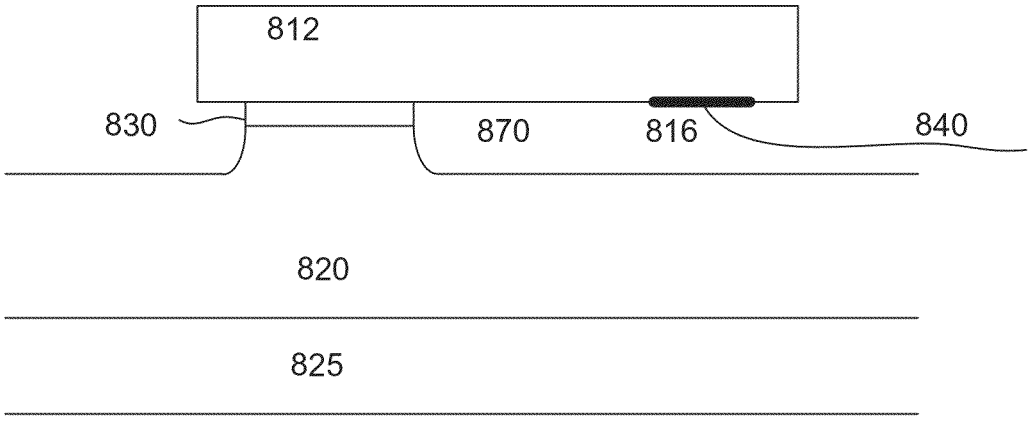
FIG. 8 shows a cross sectional view of one LED within the array and components beneath the LED.

FIG. 8 shows a cross sectional view of one LED within the array and the components beneath the LED. The LED 812 is mounted on a heat conductor 820 via a thermal pad 830. The LED 812 may be a LED package including a ceramic base. The thermal couplings between the LED 812 and thermal pad 830, and between the thermal pad 830 and heat conductor 820, have minimum thermal resistance. A major portion of the heat generated by the LED 812 is transferred to the heat conductor 820 through the highly efficient thermal channel. In one embodiment, all LEDs within the LED array are mounted on the same heat conductor via thermal pads. The heat conductor may be mounted on another heat sink 825 to further dissipate the heat. In one embodiment, the heat sink may be mounted to the heat conductor by a screw on the bottom. In another embodiment, the heat sink may be mounted by screwing the heat sink onto two ears of the heat conductor. In yet another embodiment, the heat sink may be mounted by spring steel clips that are analogous to heat sink block clips for computer CPU chips. The heat sink applies constant spring pressure between the heat conductor and head sink independent of time, temperature and cycling. The LED 812 has one or more electrical contacts 816. In one embodiment, the electric contacts 816 are wire bonds contacts. In another embodiment, the electric contacts 816 are polyamide holt-melt matrix film (Nickel fiber) that can be applied by pressure and heat. The film forms an electrical contact between the LED and contacts pads of a flex printed circuit. The flexible printed circuit 840 is electrically connected to the electrical contacts 816 to supply and fine-tune electric power for the LED 812. Light characteristics such as color rendering index (CRI) and correlated color temperature (CCT) can be adjusted by tuning the intensities of the LEDs within the array. The flexible base material in the flexible printed circuit 840 prevents cracking of ceramic bases of the LED packages due to the thermal expansion and contraction. As shown in FIG. 8, there is spacing 870 between the LED 812 and the heat conductor 820. In one embodiment, epoxy resin can be capillary backfilled in the spacing 870. As a result, the LED electrical contacts 816 is further isolated for high-voltage tracking with the thermal pad 830. The epoxy resin may be precision backfilled by a jetting applier or a drop applier.

Figure 9:
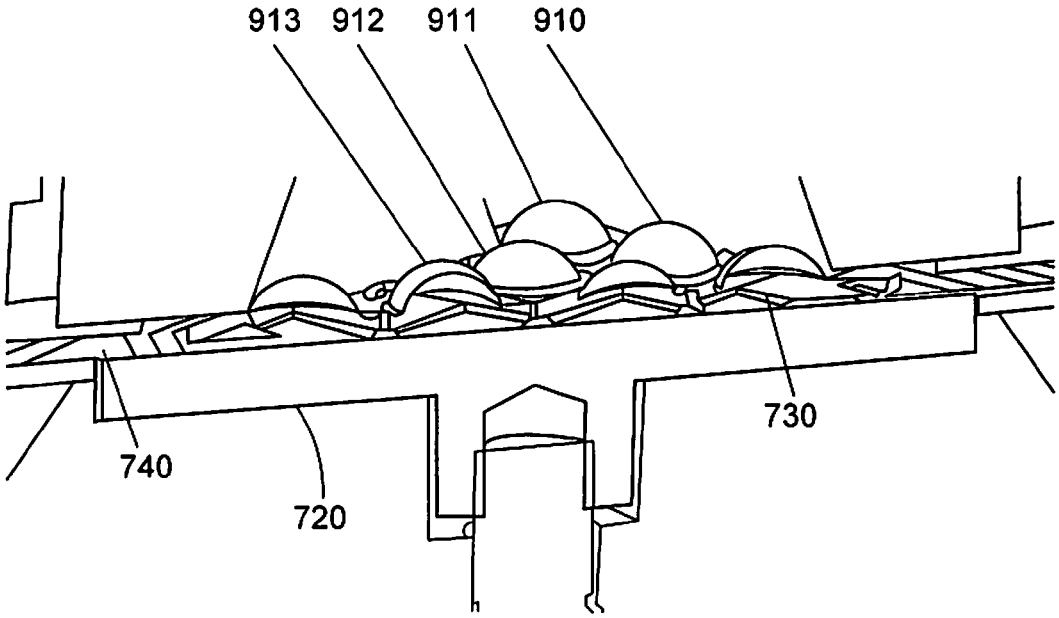
FIG. 9 shows a perspective view illustrating an LED array with a red-emitting LED, a blue-emitting LED, a yellow-emitting LED, and a cyan-emitting LED.
Figure 10:
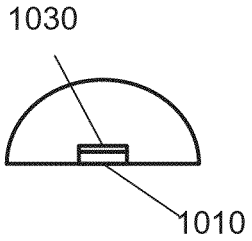
FIG. 10 shows a schematic of a yellow-emitting LED that includes a blue LED die and a YAG:Ce phosphor.
Figure 11:
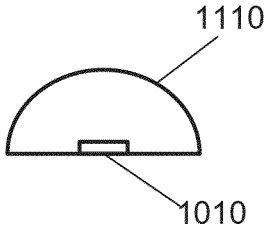
FIG. 11 shows a schematic of a yellow-emitting LED that has a hemispherical cap with a YAG:Ce phosphor coating disposed over a blue LED.

The LED array may contain LEDs with different emitting colors to achieve better color characteristics and enable color and/or CCT tuning. In one embodiment, the LED array includes one or more red-emitting LEDs 910, one or more blue-emitting LEDs 911, and one or more yellow-emitting LEDs 912, as shown in FIG. 9. As shown in the schematic of FIG. 10, the yellow-emitting LED may have a blue LED die 1010 and a YAG:Ce phosphor 1030, similar to what constructs a white-emitting LED, but with more YAG:Ce phosphor. In one embodiment, as shown in the schematic of FIG. 11, the extra YAG:Ce phosphor may be applied in a remote phosphor dome 1110 disposed over the existing white-emitting LED to form a yellow-emitting LED. The remote phosphor dome 1110 may be a hemispherical cap disposed over the LED encapsulation. In another embodiment, the extra YAG:Ce phosphor may be disposed directly within the LED packages.

Figure 12:
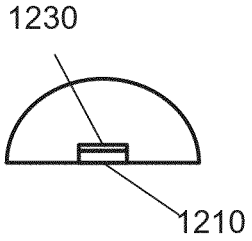
FIG. 12 shows a schematic of a cyan-emitting LED that includes a blue LED die and a Ba:Si Oxynitride Eu-doped phosphor.
Figure 13:
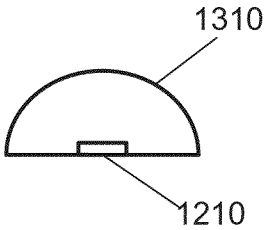
FIG. 13 shows a schematic of a cyan-emitting LED that has a hemispherical cap with a Ba:Si Oxynitride Eu-doped phosphor coating disposed over a blue LED.

In another embodiment, the LED array includes one or more red-emitting LEDs 910, one or more blue-emitting LEDs 911, one or more yellow-emitting LEDs 912, and one or more cyan-emitting LEDs 913. As shown in the schematic of FIG. 12 cyan-emitting LED 913 may have a blue LED die 1210 and a Ba:Si Oxynitride Eu-doped phosphor 1230. In one embodiment, the Ba:Si Oxynitride Eu-doped phosphor may also be disposed via a remote phosphor dome 1310 as discussed in the previous paragraph, and shown in the schematic of FIG. 13. In another embodiment, the Ba:Si Oxynitride Eu-doped phosphor may be disposed directly within the LED packages. The LED array with mixing color LEDs may achieve a wide range of correlated color temperatures (CCTs), such as from 1800 to 7000 Kelvin, while maintaining a high color rendering index (CRI) of more than 90, or even 95. The solution enables color tuning by changing the numbers of different color LEDs. Furthermore, the solution eliminates the need of white LED binning, since the color shifting is compensated by the mixing of the different color LEDs. By controlling the throttling of different color LEDs, a high CRI spectrum is rebuilt by utilizing high production volume, low cost, reliable LEDs.

CONCLUSION

Unless the context clearly requires otherwise, throughout the description and the claims, the words "comprise," "comprising," and the like are to be construed in an inclusive sense (i.e., to say, in the sense of "including, but not limited to"), as opposed to an exclusive or exhaustive sense. As used herein, the terms "connected," "coupled," or any variant thereof means any connection or coupling, either direct or indirect, between two or more elements. Such a coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. While processes or blocks are presented in a given order in this application, alternative implementations may perform routines having steps performed in a different order, or employ systems having blocks in a different order. Some processes or blocks may be deleted, moved, added, subdivided, combined, and/or modified to provide alternative or subcombinations. Also, while processes or blocks are at times shown as being performed in series, these processes or blocks may instead be performed or implemented in parallel, or may be performed at different times. Further any specific numbers noted herein are only examples. It is understood that alternative implementations may employ differing values or ranges.

The various illustrations and teachings provided herein can also be applied to systems other than the system described above. The elements and acts of the various examples described above can be combined to provide further implementations of the invention.

Any patents and applications and other references noted above, including any that may be listed in accompanying filing papers, are incorporated herein by reference. Aspects of the invention can be modified, if necessary, to employ the systems, functions, and concepts included in such references to provide further implementations of the invention.

These and other changes can be made to the invention in light of the above Detailed Description. While the above description describes certain examples of the invention, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

While certain aspects of the invention are presented below in certain claim forms, the applicant contemplates the various aspects of the invention in any number of claim forms. For example, while only one aspect of the invention is recited as a means-plus-function claim under 35 U.S.C. §112, sixth paragraph, other aspects may likewise be embodied as a means-plus-function claim, or in other forms, such as being embodied in a computer-readable medium. (Any claims intended to be treated under 35 U.S.C. §112, ¶6 will begin with the words "means for.") Accordingly, the applicant reserves the right to add additional claims after filing the application to pursue such additional claim forms for other aspects of the invention.

We claim:

1. An apparatus comprising:

an array of light emitting diodes (LEDs), wherein the array of LEDs has one or more electrical contacts through which power is supplied to the one or more LEDs;

one or more thermal pads, each thermal pad being disposed beneath one or more LEDs of the array of LEDs and thermally coupled to the one or more LEDs, wherein the one or more electrical contacts are located on a same side of the array of LEDs as the one or more thermal pads;

a heat conductor disposed beneath and thermally coupled to the one or more thermal pads at one or more protrusions of the heat conductor; and a flexible printed circuit electrically coupled to the one or more electrical contacts, wherein the apparatus further comprises resin between the LEDs and the heat conductor for high-voltage tracking isolation between the one or more thermal pads and the one or more electrical contacts of the LEDs, wherein the one or more protrusions space the heat conductor apart from the one or more electrical contacts of the LEDs for the resin to fill in.

2. The apparatus of claim 1, wherein the array of LEDs are closely arranged to form a planar Lambertian disc having a diameter of less than 18 millimeters.

3. The apparatus of claim 1, wherein the flexible printed circuit supplies electrical power to control the light intensity for each LED of the array.

4. The apparatus of claim 1, wherein an average spacing between neighboring LEDs of the array of LEDs is less than four millimeters.

5. The apparatus of claim 1, wherein an average spacing between neighboring LEDs of the array of LEDs is less than three millimeters.

6. The apparatus of claim 1, further comprising:

a heat sink thermally coupled to the heat conductor.

7. The apparatus of claim 1, wherein the one or more of thermal pads each comprise copper.

8. The apparatus of claim 1, wherein the heat conductor comprises copper.

9. The apparatus of claim 1, wherein the array of LEDs comprises LEDs emitting lights having at least three different colors.

10. The apparatus of claim 1, wherein within the array of LEDs, at least one LED is a red-emitting LED, at least one LED is a blue-emitting LED, and at least one LED is a yellow-emitting LED.

11. The apparatus of claim 10, wherein the yellow-emitting LED includes a blue LED die and a YAG:Ce phosphor.

12. The apparatus of claim 11, wherein the yellow-emitting LED further includes a hemispherical cap and at least a portion of the YAG:Ce phosphor is disposed inside of the hemispherical cap.

13. The apparatus of claim 10, wherein within the array of LEDs, at least one LED is a cyan-emitting LED.

14. The apparatus of claim 13, wherein the cyan-emitting LED includes a Ba:Si Oxynitride Eu-doped phosphor.

15. The apparatus of claim 14, wherein the cyan-emitting LED further includes a hemispherical cap and at least portion of the Ba:Si Oxynitride Eu-doped phosphor is disposed inside of the hemispherical cap.

16. An apparatus comprising:

an array of light emitting diodes (LEDs), wherein the array of LEDs has one or more electrical contacts through which power is supplied to the one or more LEDs;

a plurality of thermal pads, each thermal pad thermally coupled to a non-emitting surface of the one or more LEDs, wherein the one or more electrical contacts are located on a same side of the array of LEDs as the plurality of thermal pads;

a heat conductor thermally coupled to the plurality of thermal pads, wherein the one or more electrical contacts are spaced apart from the heat conductor; and a flexible printed circuit electrically coupled to each LED of the plurality of LEDs via the one or more electrical contacts, wherein the apparatus further comprises resin between the LEDs and the heat conductor for high-voltage tracking isolation between the one or more thermal pads and the one or more electrical contacts of the LEDs, wherein the one or more protrusions space the heat conductor apart from the one or more electrical contacts of the LEDs for the resin to fill in.

17. The apparatus of claim 16, wherein the array of LEDs are closely arranged to form a planar Lambertian disc light source.

18. The apparatus of claim 16, wherein the flexible printed circuit supplies electrical power to control the light intensity for each LED of the array.

19. The apparatus of claim 16, wherein the plurality of thermal pads each comprise copper.

20. The apparatus of claim 16, wherein the heat conductor comprises copper.

21. The apparatus of claim 16, wherein the array of LEDs comprises LEDs emitting lights having at least three different colors.

22. The apparatus of claim 16, wherein within the array of LEDs, at least one LED is a red-emitting LED, at least one LED is a blue-emitting LED, and at least one LED is a yellow-emitting LED.

23. The apparatus of claim 22, wherein within the array of LEDs, at least one LED is a cyan-emitting LED.

24. A method comprising:

thermally coupling an array of light emitting diodes (LEDs) to a plurality of thermal pads, wherein each thermal pad is disposed beneath one or more LEDs of the array of LEDs and thermally coupled to said one or more LEDs, wherein the array of LEDs has one or more electrical contacts through which power is supplied to the one or more LEDs, and further wherein the one or more electrical contacts are located on a same side of the array of LEDs as the plurality of thermal pads;

thermally coupling a heat conductor disposed beneath the plurality of thermal pads at one or more protrusions of the heat conductor, each of the one or more protrusions protruding away from a surface of the heat conductor that is spaced apart from the one or more electrical contacts; and electrically coupling a flexible printed circuit to each LED of the plurality of LEDs via the one or more electrical contacts, wherein the thermal and electrical couplings do not interfere with light emitted by the LEDs.

25. The method of claim 24, wherein the array of LEDs are closely arranged to form a planar Lambertian disc light source.

26. The method of claim 24, wherein the flexible printed circuit supplies electrical power to control the light intensity for each LED of the array.

27. The method of claim 24, wherein the plurality of thermal pads each comprise copper.

28. The method of claim 24, wherein the heat conductor comprises copper.

29. The method of claim 24, wherein the array of LEDs comprises LEDs emitting lights having at least three different colors.

30. The method of claim 24, wherein within the array of LEDs, at least one LED is a red-emitting LED, at least one LED is a blue-emitting LED, and at least one LED is a yellow-emitting LED.

31. The method of claim 30, wherein within the array of LEDs, at least one LED is a cyan-emitting LED.

* * * * *